US007993158B2

(12) United States Patent
Kang

(10) Patent No.: US 7,993,158 B2
(45) Date of Patent: Aug. 9, 2011

(54) REFRIGERATOR WITH A CONNECTOR PROTECTION FUNCTION

(75) Inventor: Dae-Kil Kang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 12/207,054

(22) Filed: Sep. 9, 2008

(65) Prior Publication Data

US 2009/0121598 A1 May 14, 2009

(30) Foreign Application Priority Data

Nov. 8, 2007 (KR) ..... 10-2007-0113853

(51) Int. Cl.
*H01R 13/52* (2006.01)

(52) U.S. Cl. ..... 439/519; 439/926; 312/401

(58) Field of Classification Search ..... 312/401, 312/223.6; 439/278–282, 519, 926, 954, 439/894

See application file for complete search history.

(56) References Cited

U.S. PATENT DOCUMENTS

| | | | | |
|---|---|---|---|---|
| 3,188,379 | A * | 6/1965 | Simon | 174/38 |
| 3,652,781 | A * | 3/1972 | Robbins | 174/67 |
| 3,870,858 | A * | 3/1975 | Schimke | 392/441 |
| 5,238,299 | A * | 8/1993 | McKinney | 312/223.6 |
| 5,318,259 | A * | 6/1994 | Fussler | 248/188.8 |
| 5,605,466 | A * | 2/1997 | Devlin et al. | 439/144 |
| 6,478,614 | B1 * | 11/2002 | De'Longhi | 439/519 |
| 7,335,042 | B2 * | 2/2008 | Chirumbolo et al. | 439/282 |
| 2009/0260249 | A1 * | 10/2009 | Renzo | 34/201 |

* cited by examiner

*Primary Examiner* — Michael C Zarroli
(74) *Attorney, Agent, or Firm* — Birch, Stewart, Kolasch & Birch, LLP

(57) ABSTRACT

A refrigerator includes a fixed connector fixed to a wall surface of a cooling space; a movable connector detachably coupled to the fixed connector; and a connector protection portion disposed above a coupling surface between the fixed connector and the movable connector, and configured to prevent moisture from being introduced into the coupling surface of the connector from the wall surface of the cooling space. Firstly, the connector protection portion configured to prevent moisture from being introduced into the coupling surface between the fixed connector and the movable connector from the wall surface of the cooling space is disposed above the coupling surface, thereby preventing damage of electric equipment or fire occurrence. Secondly, the coupling surface of the fixed connector is provided towards a front surface or is downwardly inclined towards a front side.

11 Claims, 7 Drawing Sheets

REFRIGERATOR WITH A CONNECTOR PROTECTION FUNCTION

RELATED APPLICATION

This application claims priority under 35 U.S.C. §119 to Korean Application No. 10-2007-0113853 filed in Korea on Nov. 8, 2007, the entirety of which is hereby incorporate by reference.

BACKGROUND OF THE INVENTION

1. Field of the Invention

The present invention relates to a refrigerator and more particularly, to a refrigerator having a structure to prevent moisture from being introduced into a connector of a power line for supplying power to electric equipment inside the refrigerator.

2. Description of the Background Art

Generally, a refrigerator serves to store food for a long time with a fresh state by supplying cool air obtained by a refrigerating cycle to a cooling space.

The refrigerator comprises a refrigerator body having storage spaces such as a freezing chamber, a cooling chamber, and a vegetable chamber, a refrigerating cycle device provided ay, the refrigerator body and maintaining the storage spaces at preset temperatures, and a door mounted to one side of the refrigerator body and configured to open/close the storage spaces.

According to the conventional refrigerator, a freezing chamber is disposed at an upper side of a refrigerator body whereas a cooling chamber is disposed at a lower side of the refrigerator body. However, various refrigerators are being recently presented in order to enhance spatial efficiency, such as a refrigerator that a freezing chamber and a cooling chamber are disposed side by side, and a refrigerator that a freezing chamber is disposed below a refrigerating chamber.

Also, in order to correspond to a user's various demands, a refrigerator for use solely to store wine, cosmetics, kimchi (Korean fermented vegetable), etc. is provided.

The various types of refrigerators include a plurality of electric equipment operated by receiving an external power.

For power supply to the electric equipment, a connector is provided at one external power line and a plurality of internal power lines, respectively. The connector of the external power line is fixed to a wall surface of the cooling space, and the connector of the internal power lines is coupled to the connector of the external power line. Under this configuration, power is supplied to the electric equipment.

However, the conventional refrigerator has the following problems.

Firstly, since the connector is fixedly installed at the wall surface of the cooling space, when moisture occurring at the time of a defrost process is condensed at the wall surface of the cooling space to flow down, the moisture may be introduced into the connector. This causes damage of the electric equipment.

Secondly, since the connector of the external power line is fixed in a straightly downward direction, when the connector of the internal power lines is coupled to the connector of the external power line, a user's inconvenience in assembly is caused to lower productivity. Furthermore, when a user assembles the two connectors by using his sense not by checking with his naked eyes, the electric equipment is malfunctioned to degrade the reliability of the product.

SUMMARY OF THE INVENTION

Therefore, it is an object of the present invention to provide a refrigerator capable of preventing moisture from being introduced into a coupling surface of a connector from a wall surface of a cooling space, the connector fixed to the wall surface of the cooling space.

To achieve these and other advantages and in accordance with the purpose of the present invention, as embodied and broadly described herein, there is provided a refrigerator, comprising: a fixed connector fixed to a wall surface of a cooling space; a movable connector detachably coupled to the fixed connector; and a connector protection portion disposed above a coupling surface between the fixed connector and the movable connector, and configured to prevent moisture from being introduced into the coupling surface of the connector from the wall surface of the cooling space.

The connector protection portion is protruding from the wall surface of the cooling space. Here, a fore end of the connector protection portion is more protruding than the coupling surface of the connector. A horizontal width of the connector protection portion may be wider than that of the coupling surface of the connector.

The connector protection portion may be provided so that a center portion thereof can be disposed above both side ends thereof.

The lower surface of the connector protection portion may have a gradient downwardly inclined toward a front end from a rear end of the connector protection portion.

The upper surface of the connector protection portion may also have a gradient downwardly inclined toward the front end from the rear end of the connector protection portion.

The connector protection portion may further include an extension portion downwardly extending from both side ends thereof. A lower end of the extension portion is disposed below a lower end of the coupling surface of the connector.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a refrigerator according to a first embodiment of the present invention will be explained in more detail with reference to the attached drawings.

Figure 1:
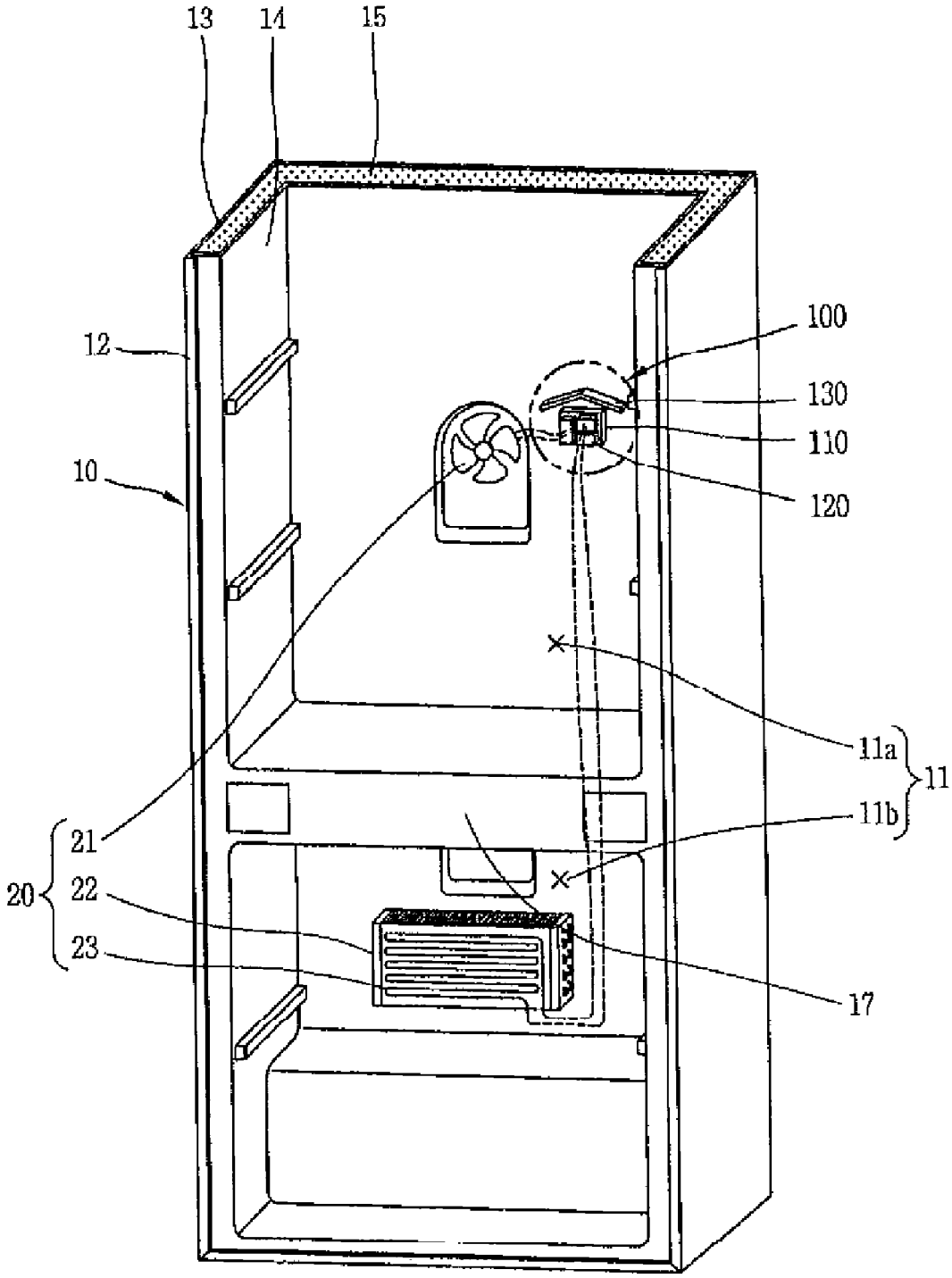
FIG. 1 is a perspective view of a cooling space of a refrigerator according to a first embodiment of the present invention.
Figure 2:
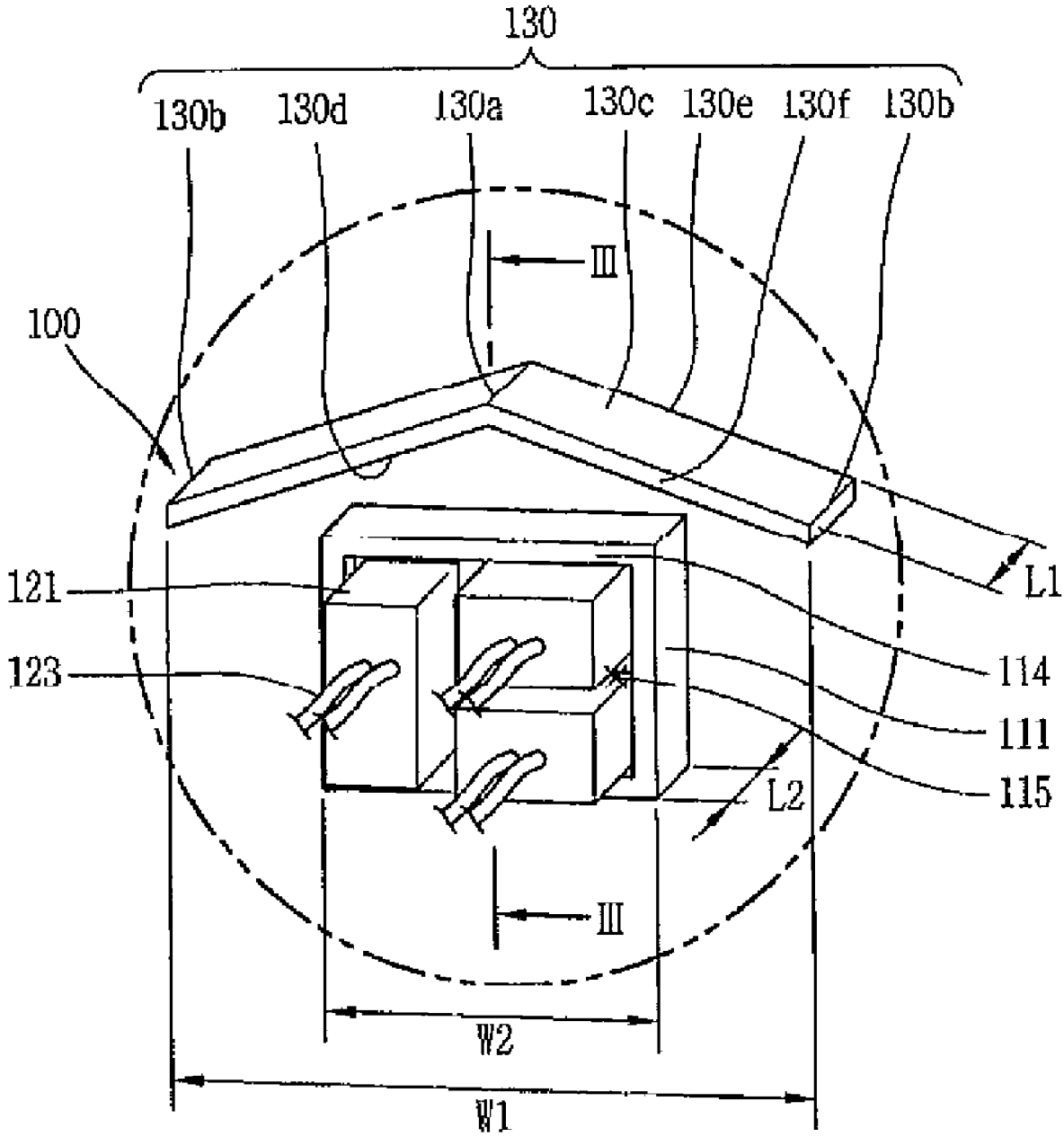
FIG. 2 is an enlarged perspective view of the cooling space of FIG. 1.
Figure 3:
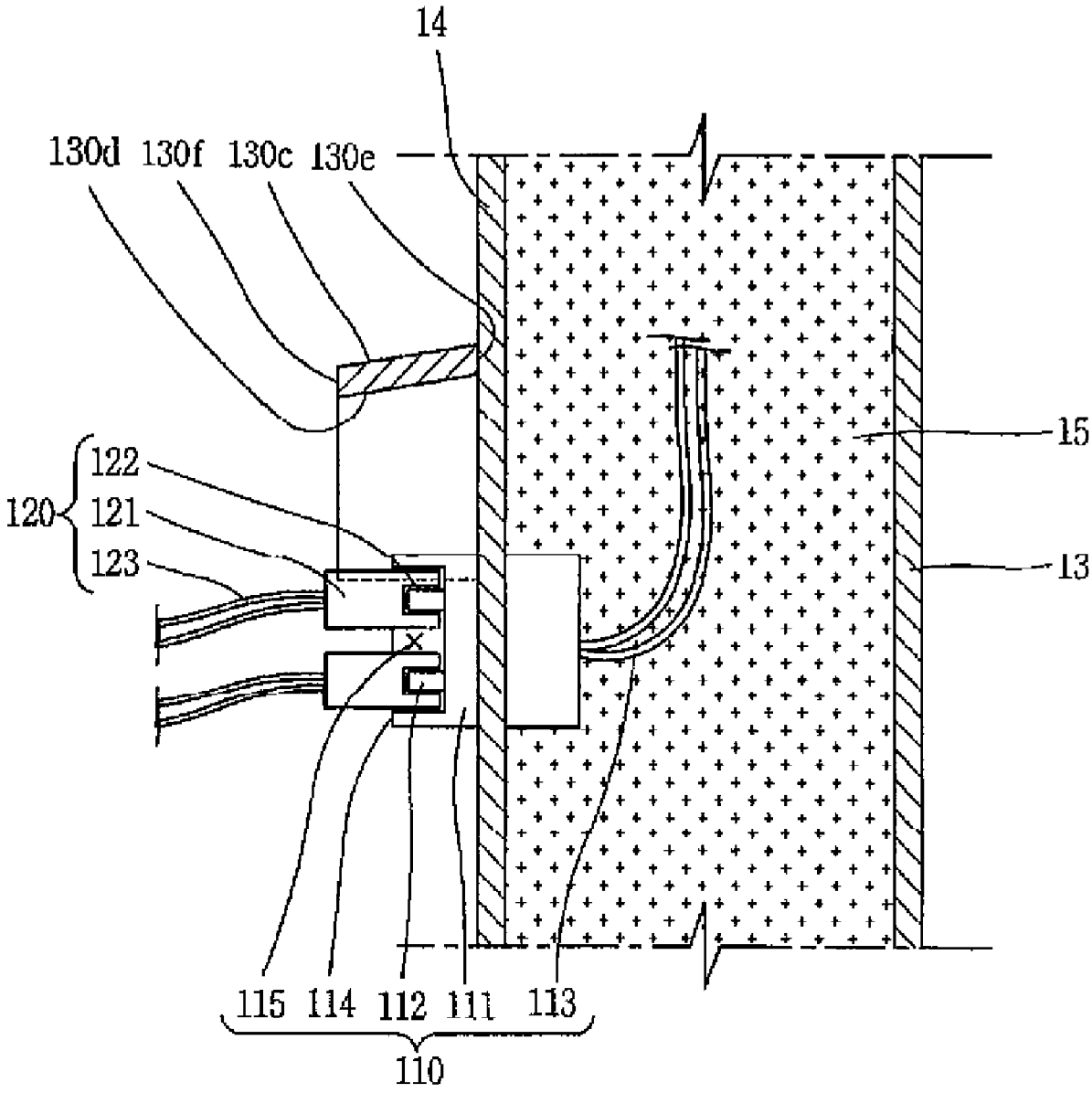
FIG. 3 is a sectional view taken along line 'III-III' in FIG. 2.

FIG. 1 is a perspective view of a cooling space of a refrigerator according to a first embodiment of the present invention, FIG. 2 is an enlarged perspective view of the cooling space of FIG. 1, and FIG. 3 is a sectional view taken along line 'III-III' in FIG. 2.

Referring to FIGS. 1 to 3, a refrigerator 10 according to the present invention comprises: a body 12 having a cooling space 11; various kinds of power consumption devices 20 to operate the refrigerator 10; and a power connection device 100 for connecting the power consumption devices 20 and an external power (not shown) to each other.

The body 12 includes an outer case 13 that forms appearance thereof; an inner case 14 disposed with a predetermined gap from the outer case 13, and having a cooling space 11 therein; and a heat insulating material 15 filled between the outer case 13 and the inner case 14.

The cooling space 11 is provided with a cooling chamber 11*a* and a freezing chamber 11*b* so that a plurality of storage spaces can be divided from one another by a partition wall 17.

The power consumption device 20 includes a blowing fan 21 configured to guide cool air generated by an evaporator 22 to the cooling space 11, and a defrost heater 23 configured to remove frost generated at the evaporator 22, etc.

The evaporator 22 and the blowing fan 21 are installed at one side of a wall surface of the cooling space 11, and are disposed behind a cover member (not shown) having a cool air outlet (not shown) through which cool air generated from the evaporator 22 is discharged to the cooling chamber 11*a* and the freezing chamber 11*b*.

The defrost heater 23 is provided at the evaporator 22 to remove frost around the evaporator 22, thereby preventing cooling efficiency from lowering due to frost.

Although not shown, a power consumption device such as each kind of sensor (not shown), a bimetal portion (not shown), and a lighting portion (not shown) may be provided.

The power connection device 100 includes a fixed connector 110 fixed to one side of a wall surface of the cooling space 11, a movable connector 120 movably coupled to the fixed connector 110, and a connector protection portion 130 for protecting a coupling surface 114, i.e., a connected part between the fixed connector 110 and the movable connector 120 from moisture.

The fixed connector 110 includes a body portion 111 formed of a fire retardant material, and a terminal receiving groove 115 formed at a front surface of the body portion 111. One side of an external power line 113 connected to an external power (not shown) is connected to a rear surface of the body portion 111.

The external power line 113 is connected to an external power (not shown) through a space where the heat insulating material 15 is filled.

A plurality of protruding terminals 112 formed of a metallic material are installed at the terminal receiving groove 115.

The fixed connector 110 is provided so that one part of the body portion 111 is coupled to the space where the heat insulating material 15 is filled, and another side thereof is protruding into the inner case 14 so as to dispose the terminal receiving groove 115 at a front side.

The movable connector 120 includes a body portion 121 formed of a fire retardant material, and a concaved terminal 122 formed of a metallic material and formed at a front surface of the body portion 121.

A rear surface of the body portion 121 is connected to the power consumption device 20 by an inner power line 123.

In the body portion 121, the concaved terminal 122 is connected to the inner power line 123. Also, the concaved terminal 122 is coupled to a protruding terminal 112 formed at the terminal receiving groove 115 of the fixed connector 110.

As the fixed connector 110 and the movable connector 120 are electrically connected to each other, an external power (not shown) is supplied to the power consumption device 20.

The connector protection portion 130 is disposed above the fixed connector 110, and is disposed at one side of a wall surface of the cooling space 11. The connector protection portion 130 is formed so as to be protruding into the inner case 14, that is, protruding to the cooling space 11 by a predetermined width (L1), and to have a predetermined length (W1) in a horizontal direction.

The connector protection portion 130 may be integrally formed with a wall surface of the cooling space 11.

The width (L1), the protruding length of the connector protection portion 130 is wider than a width (L2), a protruding length of a part of the body portion 111 of the fixed connector 110 from the wall surface of the cooling space 11.

The horizontal length (W1) of the connector protection portion 130 is longer than a horizontal length (W2) of the body portion 111 of the fixed connector 110.

The connector protection portion 130 is provided so that a central portion 130*a* thereof is disposed above side ends 130*b* thereof. The reason is in order to allow moisture introduced to the connector protection portion 130 to flow down to the side ends 130*b*.

Accordingly, the connector protection portion 130 may have variously modified shapes such as an arc shape, a curved shape, and an eyebrow shape. Also, the connector protection portion 130 may have a ring shape.

The connector protection portion 130 is composed of an upper surface 130*c* to which moisture flows from the wall surface of the cooling space 11, and a lower surface 130*d* corresponding to a backside of the upper surface 130*c*. The lower surface 130*d* of the connector protection portion 130 has a gradient downwardly inclined toward a front end 130*f* from a rear end 130*e* of the connector protection portion 130, that is, toward a protruding direction of the connector protection portion 130.

Accordingly, when moisture introduced to the upper surface 130*c* of the connector protection portion 130 drops down via the front end 130*f* of the connector protection portion 130, the moisture is prevented from flowing to the lower surface 130*d* of the connector protection portion 130 owing to the downwardly inclined gradient.

Furthermore, when moisture is generated at the lower surface 130*d* of the connector protection portion 130 due to condensation, the moisture flows to the front end 130*f* of the connector protection portion 130 along the downwardly inclined gradient.

As a result, moisture is prevented from flowing to the coupling surface 114 between the fixed connector 110 and the movable connector 120.

The upper surface 130*c* of the connector protection portion 130 has a gradient downwardly inclined toward the front end 130*f* from the rear end 130*e* of the connector protection portion 130.

Accordingly, moisture introduced to the connector protection portion 130 relatively rapidly flows along a gravity direction.

In the refrigerator 10 of the present invention, the connector protection portion 130 may further include an extension portion so as to more enhance a function to prevent moisture introduction. The extension portion will be explained in more detail with reference to FIG. 4.

Figure 4:
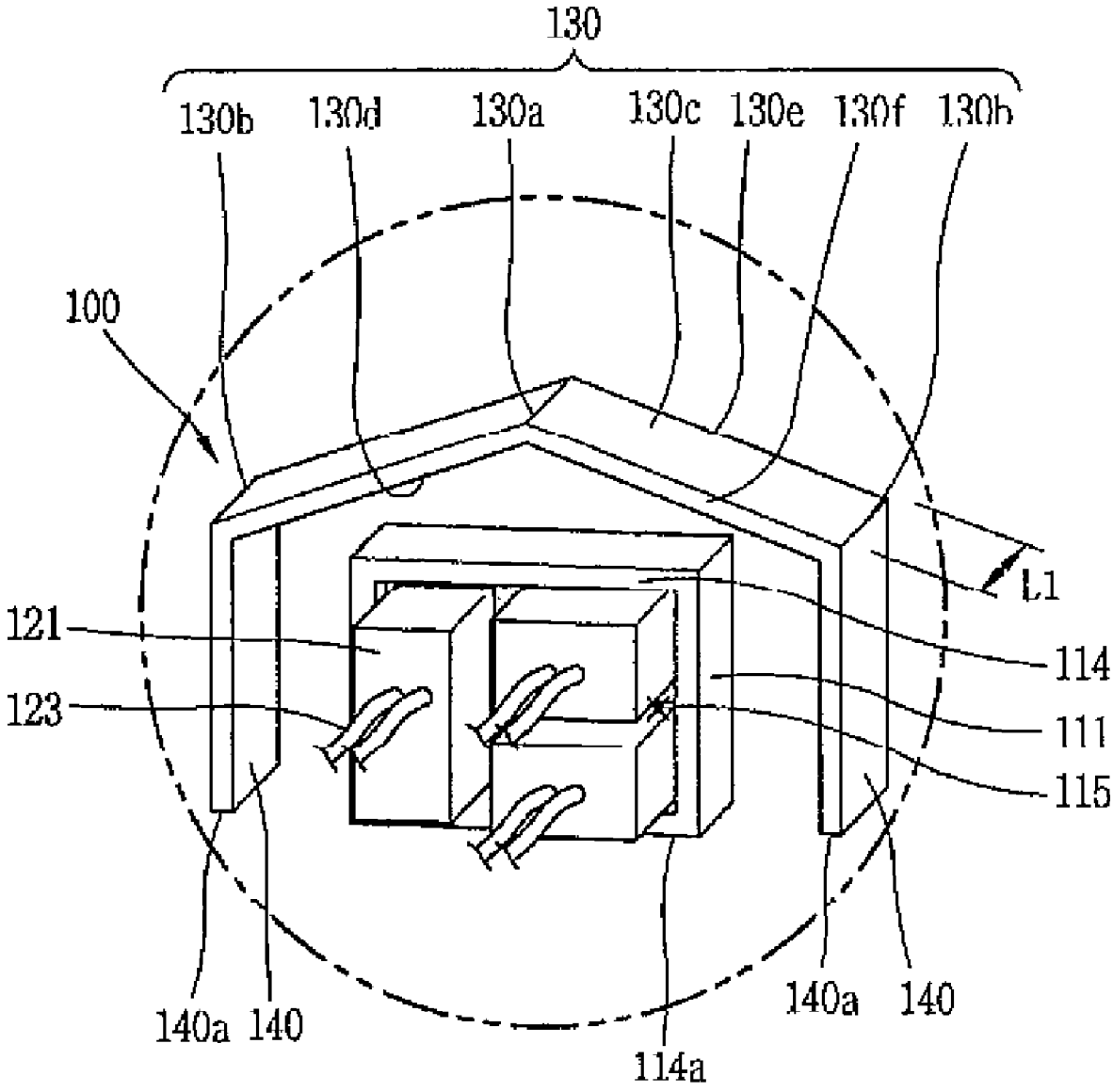
FIG. 4 is a view of FIG. 2 to which an extending portion is added.

FIG. 4 is a view of FIG. 2 to which an extending portion is added.

As shown in FIG. 4, the connector protection portion 130 further includes an extension portion 140 downwardly extending from both side ends 130*b* thereof.

The extension portion 140 has the same width (L1) as the connector protection portion 130. Preferably, a lower end 140*a* of the extension portion 140 is disposed below a lower end 114*a* of the coupling surface 114.

In FIG. 4, the extension portion 140 is extending in a straightly downward direction. However, the extension portion 140 may be extending with a predetermined inclination or curvature.

Hereinafter, operation of the refrigerator according to the first embodiment of the present invention will be explained.

Vapor generated by a defrost operation, or vapor introduced into the cooling space 11 from outside is condensed on a wall surface of the cooling space 11, thereby downwardly flowing along the wall surface.

Here, moisture flowing toward the fixed connector 110 fixed to the wall surface of the cooling space 11 is firstly introduced into the connector protection portion 130.

The moisture downwardly flows through the side ends 130*b* or the front end 130*f* of the connector protection portion 130, thereby being prevented from introducing into the coupling surface 114 between the fixed connector 110 and the movable connector 120, i.e., into the terminal receiving groove 115 of the fixed connector 110.

Hereinafter, a refrigerator according to a second embodiment of the present invention will be explained. The same parts as those of the first embodiment will be explained, but only differences from the first embodiment will be explained.

Figure 5:
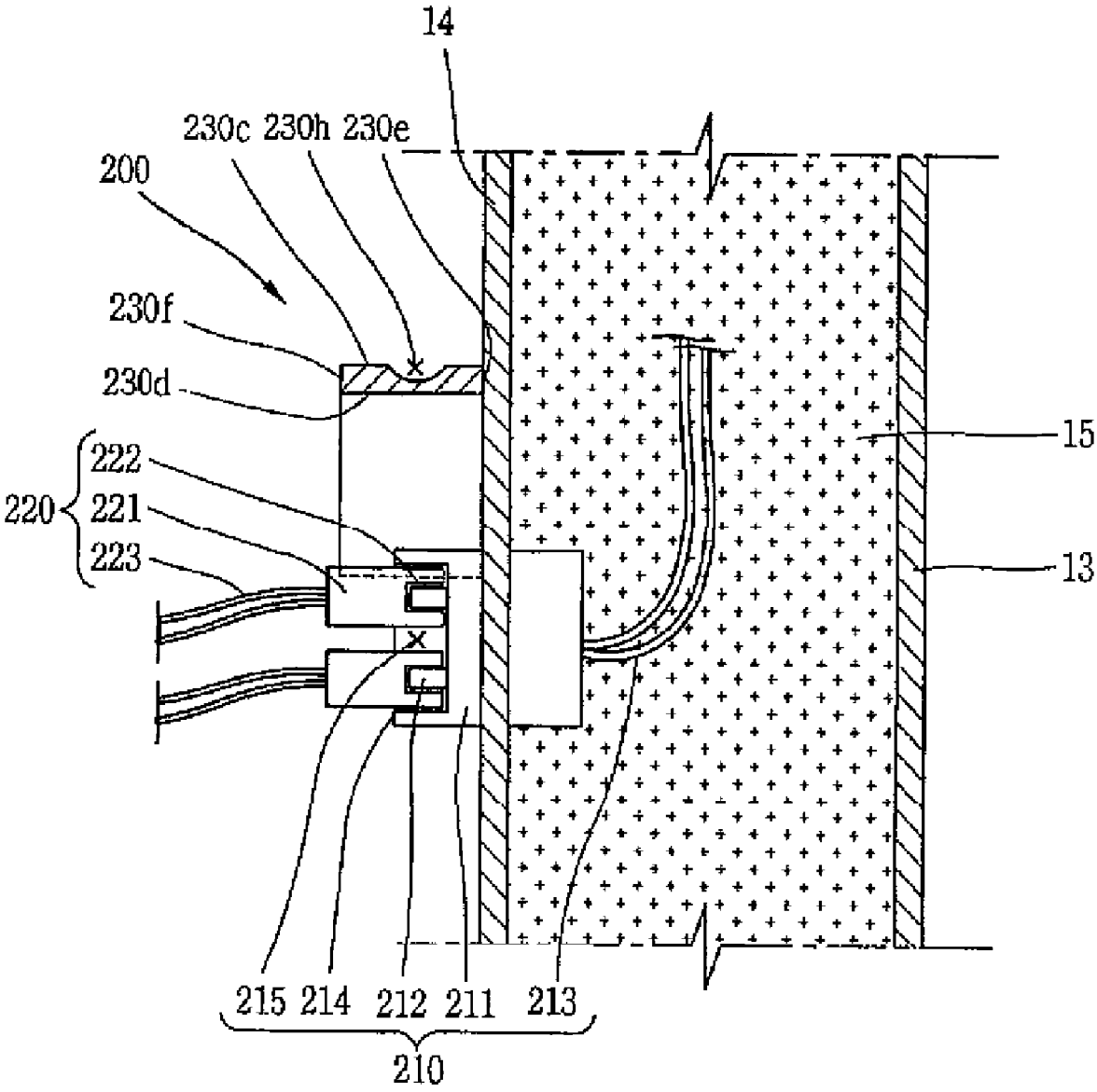
FIG. 5 is a sectional view of a main part of a refrigerator according to a second embodiment of the present invention.

FIG. 5 is a sectional view of a main part of a refrigerator according to a second embodiment of the present invention.

As shown in FIG. 5, a power connection device 200 includes a fixed connector 210, a movable connector 220, and a connector protection portion 230. A guide groove 230*h* is formed on an upper surface 230*c* of the connector protection portion 230 in a horizontal direction of the connector protection portion 230.

Accordingly, moisture introduced into the connector protection portion 230 does not flow to a front end 230*f* of the connector protection portion 230, but flows to both side ends 230*b* of the connector protection portion 230 along the guide groove 230*h*.

Therefore, moisture is prevented from dropping to a body portion 221 of the movable connector 220 through the front end 230*f* of the connector protection portion 230, thereby more effectively preventing moisture introduction.

Hereinafter, a refrigerator according to a third embodiment of the present invention will be explained. The same parts as those of the first embodiment will be explained, but only differences from the first embodiment will be explained.

Figure 6:
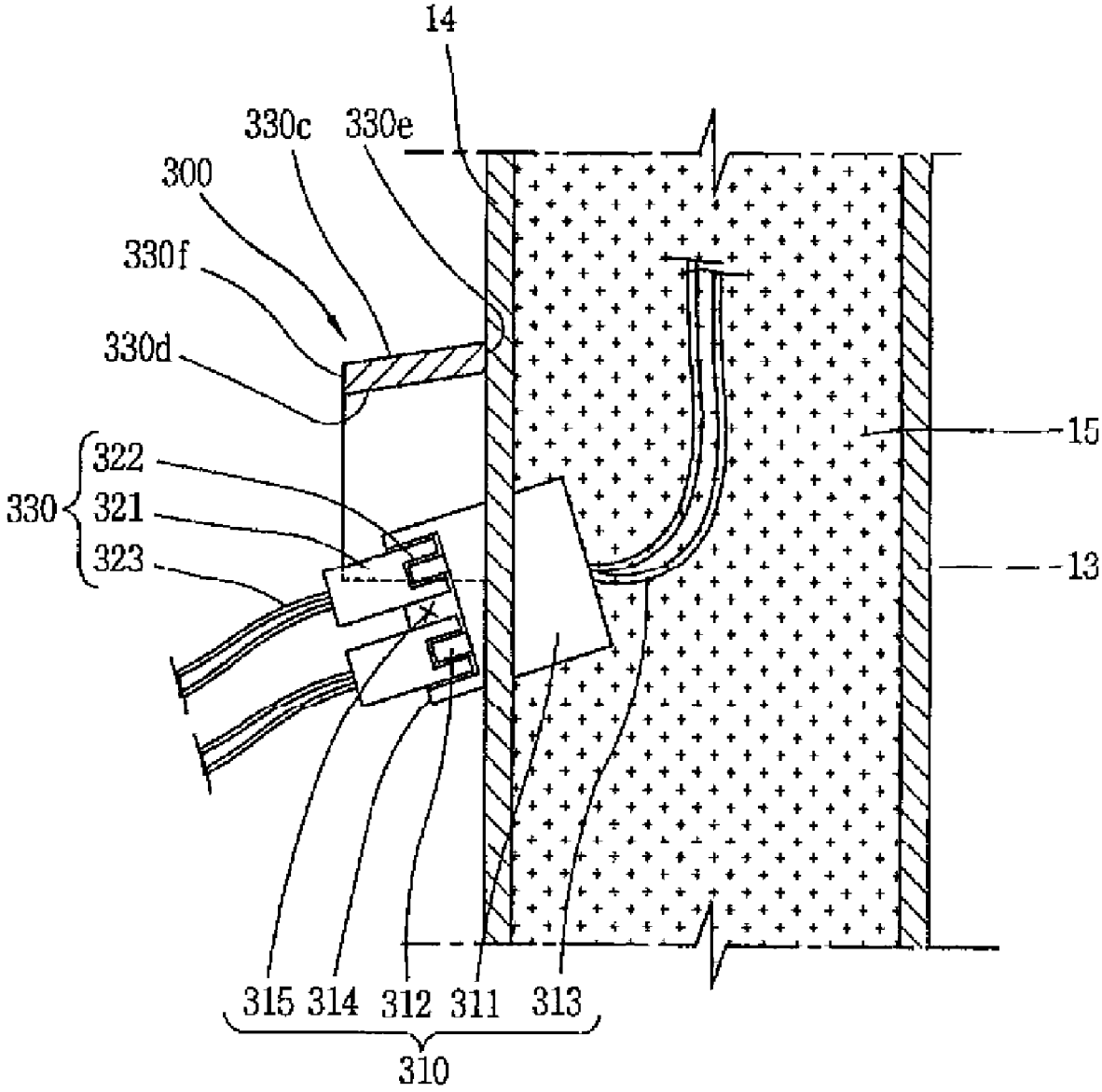
FIG. 6 is a sectional view of a main part of a refrigerator according to a third embodiment of the present invention.

FIG. 6 is a sectional view of a main part of a refrigerator according to a third embodiment of the present invention.

As shown in FIG. 6, a power connection device 300 includes a fixed connector 310, a movable connector 320, and a connector protection portion 330. The fixed connector 310 is downwardly fixed to a wall surface 14 of the cooling space 11 toward the cooling space 11.

Accordingly, even if moisture downwardly dropping via a front end 330*f* of the connector protection portion 330 drops to a body portion 321 of the movable connector 320, the moisture is scarcely introduced into a coupling surface 314 between the fixed connector 310 and the movable connector 320.

Hereinafter, a refrigerator according to a fourth embodiment of the present invention will be explained. The same parts as those of the first embodiment will be explained, but only differences from the first embodiment will be explained.

Figure 7:
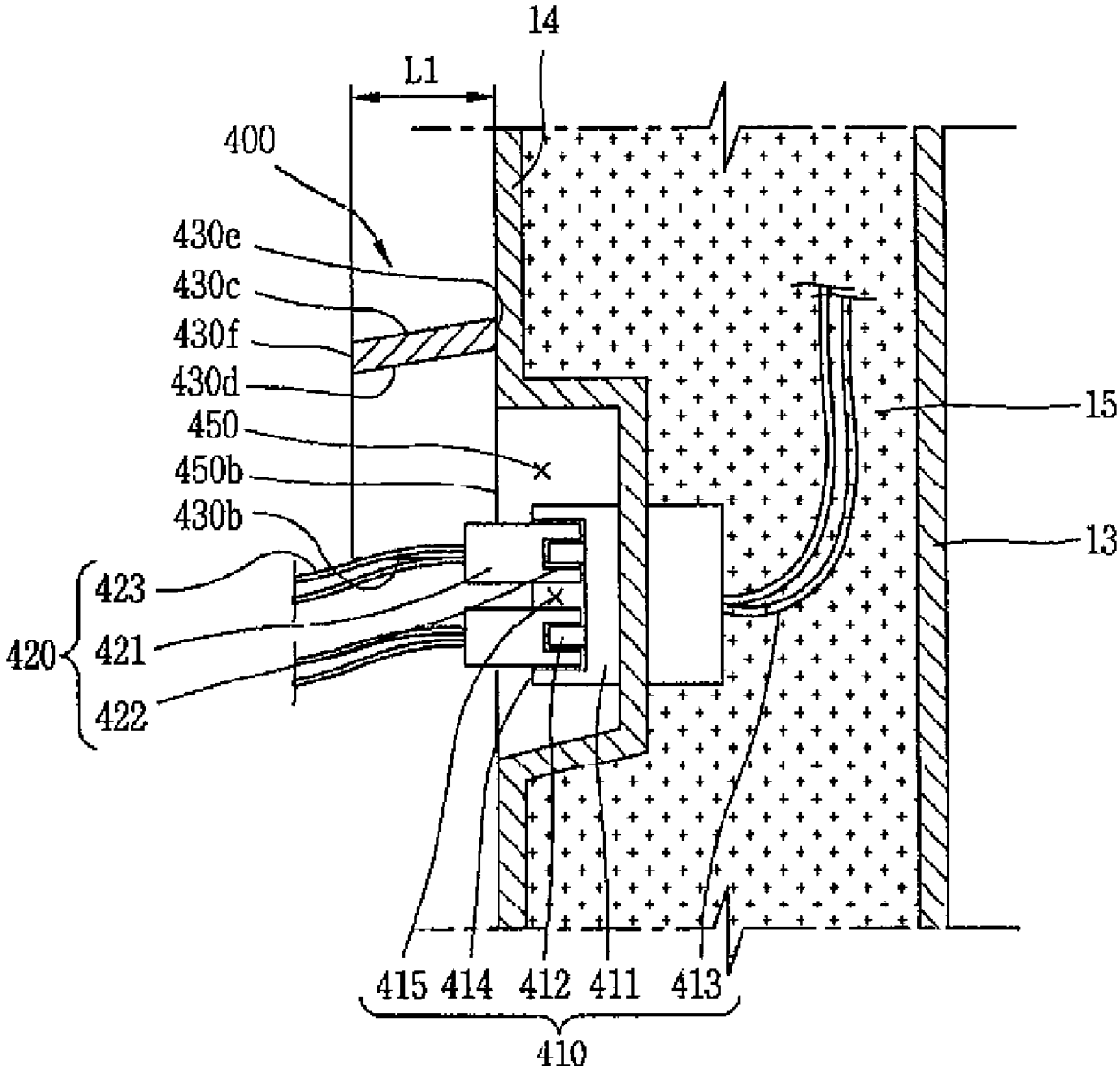
FIG. 7 is a sectional view of a main part of a refrigerator according to a fourth embodiment of the present invention.

FIG. 7 is a sectional view of a main part of a refrigerator according to a fourth embodiment of the present invention.

As shown in FIG. 7, a power connection device 400 includes a fixed connector 410, a movable connector 420, and a connector protection portion 430. The fixed connector 410 is fixed to a connector receiving portion 450 formed as one side of the wall surface 14 of the cooling space 11 is concaved in a thickness direction.

Since a protruding length of the fixed connector 410 from the wall surface 14 of the cooling space 11 is decreased, the width (L1) of the connector protection portion 430 can be decreased. Accordingly, moisture introduction into a coupling surface 414 between the fixed connector 410 and the movable connector 420 can be more effectively prevented.

In the present invention, a bottom surface 450*a* of the connector receiving portion 450 is formed so as to be downwardly inclined to a front surface 450*b* of the connector receiving portion 450, i.e., the cooling space 11.

Accordingly, moisture condensed in the connector receiving portion 450 downwardly flows along a downwardly inclined gradient of the bottom surface 450*a*.

The refrigerator according to the present invention has the following effects.

Firstly, the connector protection portion configured to prevent moisture from being introduced into the coupling surface between the fixed connector and the movable connector from the wall surface of the cooling space is disposed above the coupling surface, thereby preventing damage of electric equipment or fire occurrence.

Secondly, the coupling surface of the fixed connector is provided towards a front surface or is downwardly inclined towards a front side. Accordingly, the movable connector can be assembled to the fixed connector while a user identifies the coupling surface of the connector with his eyes. This causes product inferiority to be low, thereby enhancing a user's satisfaction degree.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator with a connector protection function, comprising:

a fixed connector fixed to a wall surface of a cooling space;

a movable connector detachably coupled to the fixed connector; and a connector protection portion disposed above a coupling surface between the fixed connector and the movable connector, and configured to prevent moisture from being introduced into the coupling surface of the connector from the wall surface of the cooling space, wherein the connector protection portion is protruding from the wall surface of the cooling space, a fore end of the connector protection portion is more protruding than the coupling surface of the connector, and a horizontal width of the connector protection portion is wider than that of the coupling surface of the connector, and wherein the connector protection portion is provided so that a center portion thereof can be disposed above both side ends thereof.

2. The refrigerator of claim 1, wherein the fixed connector is fixed to the wall surface of the cooling space so as to be downwardly inclined toward a front side.

3. The refrigerator of claim 1, wherein the fixed connector is fixed to a connector receiving portion formed as one side of the wall surface of the cooling space is concaved in a thickness direction.

4. The refrigerator of claim 3, wherein the connector receiving portion is formed so that a bottom surface thereof is downwardly inclined toward a front surface thereof.

5. The refrigerator of claim 1, wherein a lower surface of the connector protection portion has a gradient downwardly inclined toward a front end from a rear end of the connector protection portion.

6. The refrigerator of claim 5, wherein an upper surface of the connector protection portion has a gradient downwardly inclined toward the front end from the rear end of the connector protection portion.

7. The refrigerator of claim 1, wherein a guide groove is formed on an upper surface of the connector protection portion in a horizontal direction of the connector protection portion.

8. The refrigerator of claim 1, wherein the connector protection portion further comprises an extension portion downwardly extending from both side ends thereof, and a lower end of the extension portion is disposed below a lower end of the coupling surface of the connector.

9. A refrigerator with a connector protection function, comprising:

a fixed connector fixed to a wall surface of a cooling space;

a movable connector detachably coupled to the fixed connector; and a connector protection portion disposed above a coupling surface between the fixed connector and the movable connector, and configured to prevent moisture from being introduced into the coupling surface of the connector from the wall surface of the cooling space, wherein the connector protection portion is protruding from the wall surface of the cooling space, a fore end of the connector protection portion is more protruding than the coupling surface of the connector, and a horizontal width of the connector protection portion is wider than that of the coupling surface of the connector, and wherein the fixed connector is fixed to the wall surface of the cooling space so as to be downwardly inclined toward a front side.

10. A refrigerator with a connector protection function, comprising:

a fixed connector fixed to a wall surface of a cooling space;

a movable connector detachably coupled to the fixed connector; and a connector protection portion disposed above a coupling surface between the fixed connector and the movable connector, and configured to prevent moisture from being introduced into the coupling surface of the connector from the wall surface of the cooling space, wherein the connector protection portion is protruding from the wall surface of the cooling space, a fore end of the connector protection portion is more protruding than the coupling surface of the connector, and a horizontal width of the connector protection portion is wider than that of the coupling surface of the connector, and wherein the fixed connector is fixed to a connector receiving portion formed as one side of the wall surface of the cooling space that is concaved in a thickness direction.

11. The refrigerator of claim 10, wherein the connector receiving portion is formed so that a bottom surface thereof is downwardly inclined toward a front surface thereof.

* * * * *